US009797033B2

(12) United States Patent
Li et al.

(10) Patent No.: US 9,797,033 B2
(45) Date of Patent: Oct. 24, 2017

(54) HIGH-STRENGTH, HIGH-TOUGHNESS, WEAR-RESISTANT STEEL PLATE AND MANUFACTURING METHOD THEREOF

(71) Applicant: Baoshan Iron & Steel Co., Ltd., Shanghai (CN)

(72) Inventors: Hongbin Li, Shanghai (CN); Liandeng Yao, Shanghai (CN); Yuchuan Miao, Shanghai (CN)

(73) Assignee: BAOSHAN IRON & STEELE CO., LTD., Shanghai (CN)

( * ) Notice: Subject to any disclaimer, the term of this patent is extended or adjusted under 35 U.S.C. 154(b) by 153 days.

(21) Appl. No.: 14/418,904

(22) PCT Filed: Jan. 31, 2013

(86) PCT No.: PCT/CN2013/071179

§ 371 (c)(1),
(2) Date: Jan. 30, 2015

(87) PCT Pub. No.: WO2014/019352

PCT Pub. Date: Feb. 6, 2014

(65) Prior Publication Data

US 2015/0211098 A1 Jul. 30, 2015

(30) Foreign Application Priority Data

Jul. 31, 2012 (CN) ..... 2012 1 0269896

(51) Int. Cl.
*C22C 38/14* (2006.01)
*C22C 38/32* (2006.01)
(Continued)

(52) U.S. Cl.
CPC ..... *C22C 38/38* (2013.01); *C21D 6/002* (2013.01); *C21D 6/005* (2013.01); *C21D 6/008* (2013.01);
(Continued)

(58) Field of Classification Search
CPC ..... C22C 38/06; C22C 38/14; C22C 38/18; C22C 38/26; C22C 38/28; C22C 38/32
(Continued)

(56) References Cited

U.S. PATENT DOCUMENTS 6,264,760 B1 * 7/2001 Tamehiro ..... C21D 1/19 148/330
2007/0144632 A1 * 6/2007 Toyoda ..... C21D 8/0226 148/593
(Continued)

FOREIGN PATENT DOCUMENTS

AU 2009355404 A1 5/2012
CN 1626695 A 6/2005
(Continued)

OTHER PUBLICATIONS

International Search Report from PCT/CN2013/071179, dated Apr. 25, 2013 (English Translation version).
(Continued)

*Primary Examiner* — Matthew E Hoban
(74) *Attorney, Agent, or Firm* — Kilpatrick Townsend & Stockton LLP

(57) ABSTRACT

The invention provides a wear-resistant steel plate, which has the following chemical composition (wt. %): C: 0.08-0.21%, Si: 0.15-0.45%, Mn: 1.10-1.80%, P: ≤0.015%, S: ≤0.010%, Nb: 0.010-0.040%, Al: 0.010-0.080%, B: 0.0006-0.0014%, Ti: 0.005-0.050%, Ca: 0.0010-0.0080%, V≤0.080%, Cr≤0.60%, N≤0.0080%, O≤0.0060%, H≤0.0004%, wherein 0.025%≤Nb+Ti≤0.080%, 0.030%≤Al+Ti≤0.12%, and the balance being Fe and unavoidable impurities. The invention also provides a method of manufacturing the wear-resistant steel plate, comprising smelting, casting, rolling, post-rolling direct cooling, inter alia. The wear-resistant steel plate obtained from the above composition and process has perfect weld-
(Continued)

ability, high strength, high hardness, good low-temperature toughness, and excellent machinability, and is suitable for quick-wear devices in engineering and mining machinery, such as bucket, mining vehicle body and scraper transporter, etc.

15 Claims, 2 Drawing Sheets

(51) Int. Cl.

| | |
|---|---|
| ***C22C 38/38*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/24*** | (2006.01) |
| ***C22C 38/26*** | (2006.01) |
| ***C22C 38/28*** | (2006.01) |
| ***C21D 6/00*** | (2006.01) |
| ***C21D 9/46*** | (2006.01) |

(52) U.S. Cl.
CPC ..... *C21D 8/02* (2013.01); *C21D 8/021* (2013.01); *C21D 8/0226* (2013.01); *C21D 8/0263* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/24* (2013.01); *C22C 38/26* (2013.01); *C22C 38/28* (2013.01); *C22C 38/32* (2013.01)

(58) Field of Classification Search
USPC ..... 420/127
See application file for complete search history.

(56) References Cited

U.S. PATENT DOCUMENTS

| | | | | |
|---|---|---|---|---|
| 2008/0156400 | A1* | 7/2008 | Nakashima | C21C 7/0006 148/331 |
| 2013/0216422 | A1* | 8/2013 | Ueda | C21D 8/02 420/83 |
| 2014/0090755 | A1* | 4/2014 | Ueda | C22C 38/02 148/645 |
| 2014/0124102 | A1 | 5/2014 | Zhang et al. | |

FOREIGN PATENT DOCUMENTS

| | | | |
|---|---|---|---|
| CN | 1680613 | A | 10/2005 |
| CN | 101676425 | A | 3/2010 |
| CN | 101775545 | * | 7/2010 |
| CN | 102134682 | A | 7/2011 |
| CN | 102953001 | A | 8/2011 |
| CN | 102363859 | A | 2/2012 |
| CN | 102373384 | A | 3/2012 |
| CN | 102560272 | A | 7/2012 |
| CN | 102605234 | A | 7/2012 |
| CN | 102747280 | A | 10/2012 |
| EP | 2589676 | A1 | 5/2013 |
| JP | 2005336548 | A | 12/2005 |
| JP | 2011179122 | A | 9/2011 |
| WO | 2011/061812 | A1 | 5/2011 |

OTHER PUBLICATIONS

CN201210269896.4, First Office Action, dated May 13, 2013, pp. 1-9.
CN201210269896.4, Third Office Action, dated Feb. 25, 2014, pp. 1-10.
EP13763172.7, Office Action, dated Feb. 23, 2017, pp. 1-4.
EP13763172.7, Search Report, dated Aug. 28, 2015, pp. 1-7.
JP2014-527489, Office Action, dated Nov. 18, 2014, pp. 1-5.
NZ614798, Office Action, dated Jun. 9, 2015.

* cited by examiner

HIGH-STRENGTH, HIGH-TOUGHNESS, WEAR-RESISTANT STEEL PLATE AND MANUFACTURING METHOD THEREOF

TECHNICAL FIELD

The invention relates to wear-resistant steel, in particular to a low-alloy, readily weldable, high-strength, high-toughness, wear-resistant steel plate and a method for manufacturing the same.

BACKGROUND ART

The wear-resistant steel plate is widely used for mechanical products for use in engineering, mining, agriculture, cement production, harbor, electric power, metallurgy and the like wherein operating conditions are particularly awful and high-strength as well as high wear resistance properties are required. For example, bulldozer, loader, excavator, dump truck and grab bucket, stacker-reclaimer, delivery bend structure, etc. may be mentioned.

In recent decades, the development and application of wear-resistant steel grows quickly. Generally, carbon content is increased and suitable amounts of trace elements such as chromium, molybdenum, nickel, vanadium, tungsten, cobalt, boron, titanium and the like are added to enhance the mechanical properties of wear-resistant steel by taking full advantage of various strengthening means such as precipitation strengthening, fine grain strengthening, transformation strengthening and dislocation strengthening, inter alia. Since wear-resistant steel is mostly medium carbon, medium-high carbon or high carbon steel, increase of carbon content leads to decreased toughness, and excessively high carbon content exasperates the weldability of steel badly. In addition, increase of alloy content will result in increased cost and degraded weldability. These drawbacks refrain further development of wear-resistant steel.

Notwithstanding the wear resistance of a material mainly depends on its hardness, and toughness has significant influence on the wear resistance of the material, too. Under complicated working conditions, good wear resistance and long service life of a material can not be guaranteed by increasing the hardness of the material alone. Adjusting the components and thermal treatment process, and controlling the appropriate matching between the hardness and toughness of low-alloy wear-resistant steel, may result in superior comprehensive mechanical properties, so that the requirements of different wearing conditions may be satisfied.

Welding is a greatly important processing procedure and plays a vital role in engineering application as it can realize joining between various steel materials. Weld cold cracking is the most common welding process flaw. Particularly, cold cracking has a great tendency to occur when high-strength steel is welded. Generally, preheating before welding and thermal treatment after welding are used to prevent cold cracking, which complicates the welding process, renders the process inoperable in special cases, and imperils the safety and reliability of the welded structure. For high-strength, high-hardness, wear-resistant steel plates, the welding-related problems are particularly prominent.

CN1140205A has disclosed a wear-resistant steel having medium carbon and medium alloy contents, the contents of carbon and alloy elements (Cr, Mo, etc.) of which are far higher than those of the present invention. This will inevitably lead to poor weldability and machinability.

CN1865481A has disclosed a wear-resistant bainite steel which has higher contents of carbon and alloy elements (Si, Mn, Cr, Mo, etc.) and poorer weldability and mechanical properties in comparison with the present invention.

SUMMARY

The object of the invention is to provide a low-alloy, readily weldable, high-strength, high-toughness, wear-resistant steel plate by realizing the matching between high strength, high hardness and high toughness on the basis of adding trace alloy elements, so as to achieve extremely good weldability and superior machining property which benefit the wide application of the steel plate in engineering.

In order to realize the above object, the low-alloy, readily weldable, high-strength, high-toughness, wear-resistant steel plate according to the invention has the following chemical components in weight percentages: C: 0.08-0.21%, Si: 0.15-0.45%, Mn: 1.10-1.80%, P: ≤0.015%, S: ≤0.010%, Nb: 0.010-0.040%, Al: 0.010-0.080%, B: 0.0006-0.0014%, Ti: 0.005-0.050%, Ca: 0.0010-0.0080%, V≤0.080%, Cr≤0.60%, N≤0.0080%, O≤0.0060%, H≤0.0004%, wherein 0.025%≤Nb+Ti≤0.080%, 0.030%≤Al+Ti≤0.12%, and the balance being Fe and unavoidable impurities.

The microstructure of the wear-resistant steel according to the invention mainly comprises martensite and residual austenite, wherein the volume fraction of the residual austenite is ≤5%.

Another object of the invention is to provide a method of manufacturing the low-alloy, readily weldable, high-strength, high-toughness, wear-resistant steel plate, wherein the method comprises in sequence the steps of smelting, casting, heating, rolling and post-rolling direct cooling, etc. In the heating step, the material is heated to 1000-1200° C. In the rolling step, the initial rolling temperature is 950-1150° C. and the end rolling temperature is 800-950° C. In the post-rolling direct cooling step, water cooling is used and the end cooling temperature is from room temperature to 300° C.

The chemical composition of the material has significant influence on the weldability. The influence of carbon and alloy elements on the weldability of steel may be expressed using carbon equivalent of steel. By estimating the carbon equivalent of steel, the cold cracking sensitivity of a low-alloy, high-strength steel may be weighed preliminarily. The lower the carbon equivalent is, the better the weldability is, and vice versa, a higher carbon equivalent will result in worse weldability. This may be an important guide for determining welding process conditions such as preheating, post-welding thermal treatment, linear energy, etc. The carbon equivalent formula accepted by International Institute of Welding is $$Ceq=C+Mn/6+(Cr+Mo+V)/5+(Ni+Cu)/15$$

The weld crack sensitivity index Pcm of a steel plate having low weld crack sensitivity may be determined using the following formula:

$$Pcm=C+Si/30+Ni/60+(Mn+Cr+Cu)/20+Mo/15+V/10+5B$$

The weld crack sensitivity index Pcm represents the indicator for judging the weld cold cracking inclination of steel. When Pcm is lower, the weldability is better. Inversely, the weldability is worse. Good weldability means that the occurrence of weld cracking is not easy during welding. In contrast, cracks easily occur in the steel having poor weldability. In order to prevent cracking, steel is preheated before welding. When the weldability is better, lower preheating temperature is required, or preheating may even be exempted. Inversely, higher preheating temperature is necessary.

Owing to the scientifically designed contents of carbon and alloy elements according to the invention, the steel plate has excellent mechanical properties (strength, hardness, elongation, impact resistance, inter alia), weldability and wear resistance resulting from the refining and strengthening function of the trace alloy elements as well as the control over the refining and strengthening effect of rolling and cooling processes.

The invention differs from the prior art mainly in the following aspects:

In terms of chemical components, the wear-resistant steel according to the invention incorporates small amounts of such elements as Nb, etc. into its chemical composition in addition to C, Si, Mn and like elements, and thus is characterized by simple composition, low cost, etc.;

In terms of production process, a TMCP process is used to produce the wear-resistant steel plate according to the invention without off-line quenching, tempering and other thermal treatment procedures, and thus is characterized by a short production flow, high production efficiency, reduced energy consumption, lower production cost, etc.;

In terms of product property, the wear-resistant steel plate according to the invention has high strength, high hardness and especially very high low-temperature toughness, and the steel plate produced according to the invention has excellent weldability.

In terms of microstructure, the microstructure of the wear-resistant steel according to the invention mainly comprises fine martensite and residual austenite, wherein the volume fraction of the residual austenite is ≤5%, which facilitates the good matching between the strength, hardness and toughness of the wear-resistant steel plate.

The wear-resistant steel plate according to the invention has relatively remarkable advantages. As the development of social economy and steel industry is concerned, an inevitable tendency is the control of the contents of carbon and alloy elements, and the development of low-cost wear-resistant steel having good weldability and mechanical properties via a simple process.

DETAILED DESCRIPTION

Figure 1:
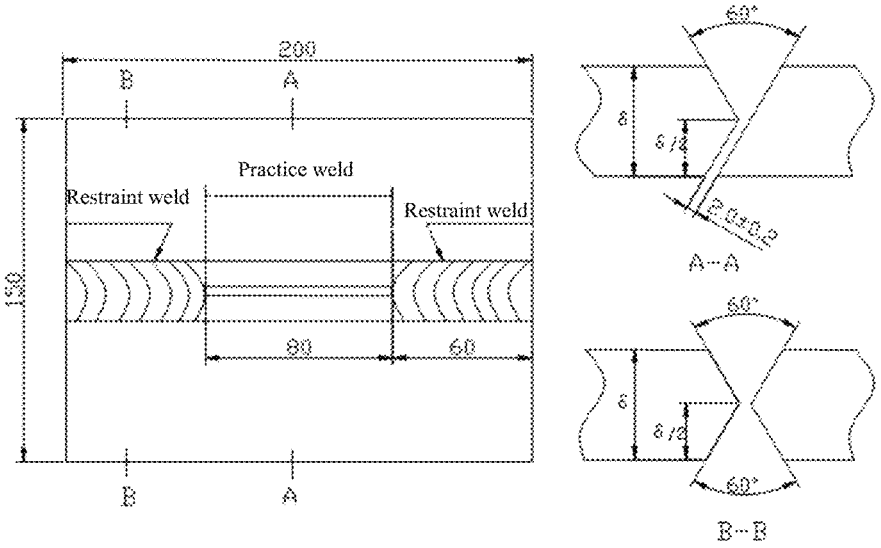
FIG. 1 shows the shape and size of a Y-groove weld cracking test coupon in a welding test.

The present invention will be further demonstrated with reference to some examples. These examples are only intended to describe some embodiments of the invention without limiting the scope of the invention.

In the invention, unless otherwise specified, contents are represented by weight percentages.

The functions of the chemical components in the low-alloy, readily weldable, high-strength, high-toughness, wear-resistant steel plate according to the invention are as follows:

Carbon: Carbon is the most basic and important element in wear-resistant steel. It can improve the strength and hardness of the steel, and further improve the wear resistance of the steel. However, it will deteriorate the toughness and weldability of the steel. Hence, the carbon content in the steel shall be reasonably controlled to be 0.08-0.21%, preferably 0.11-0.19%.

Silicon: Silicon forms a solid solution in ferrite and austenite to improve their hardness and strength. However, excessive silicon will decrease the steel toughness sharply. Meanwhile, due to better affinity of silicon with oxygen than that with iron, silicate having low melting point tends to be generated easily during welding, which increases slag and the mobility of molten metals, and thus impacts the quality of the weld. Therefore, it is undesirable to have excessive silicon. The content of silicon in the invention is controlled to be 0.15-0.45%, preferably 0.15-0.40%.

Manganese: Manganese significantly increases the hardenability of steel, and lowers the transition temperature of wear-resistant steel and the critical cooling rate of the steel. However, higher content of manganese tends to coarsen the grains, increase the temper embrittlement sensitivity of the steel, result in segregation and cracking easily in the cast billet, and degrade the properties of the steel plate. In the invention, the content of manganese is controlled to be 1.10-1.80%, preferably 1.20-1.70%.

Niobium: The function of Nb in grain refining and precipitation strengthening contributes significantly to increased strength and toughness of the material. As an element having a strong propensity to form carbide and nitride, niobium restrains the growth of austenite grains consumingly. Nb increases both the strength and toughness of steel by refining grains. Nb ameliorates and enhances the properties of steel mainly by way of precipitation strengthening and transformation strengthening. Nb has already been considered as one of the most effective strengthening agents in HSLA steel. In the invention, niobium is controlled to be 0.010-0.040%, preferably 0.010-0.035%.

Aluminum: Aluminum and nitrogen in steel can form insoluble fine AlN particles to refine steel grains. Aluminum can refine steel grains, immobilize nitrogen and oxygen in the steel, lessen the notch sensitivity of the steel, reduce or eliminate the aging phenomenon of the steel, and enhance the toughness of the steel. In the invention, the content of Al is controlled to be 0.010-0.080%, preferably 0.020-0.060%.

Boron: Boron improves the hardenability of steel, but excessive content will lead to hot shortness, and impact the weldability and hot workability of the steel. Therefore, the content of boron shall be strictly controlled. In the invention, the content of boron is controlled to be 0.0006-0.0014%, preferably 0.0008-0.0014%.

Titanium: Titanium is one of the elements having a strong tendency to form carbides, and forms fine TiC particles with carbon. TiC particles are very small, and distribute along the crystal boundary, so as to represent the effect of refining grains. Harder TiC particles will enhance the wear resistance of the steel. In the invention, titanium is controlled to be 0.005-0.050%, preferably 0.005-0.045%.

The addition of niobium and titanium in combination may result in better effect in grain refining, reduce the grain size of the original austenite, favor the martensite lathe after refining and quenching, and increase the strength and wear resistance. The insolubility of TiN and the like at high temperature may prevent grains in the heat affected zone from coarsening, and enhance the toughness of the heat affected zone, so as to improve the weldability of the steel. Hence, the contents of niobium and titanium meet the following relationship: 0.025%≤Nb+Ti≤0.080%, preferably 0.035%≤Nb+Ti≤0.070%.

Titanium can form fine particles and thus refine grains. Aluminum may guarantee the formation of fine titanium particles, so that titanium may play a full role in refining grains. Hence, the content ranges of aluminum and titanium meet the following relationship: 0.030%≤Al+Ti≤0.12%, preferably 0.040%≤Al+Ti≤0.11%.

Calcium: Calcium has a remarkable effect on the transformation of the inclusions in cast steel. Addition of a suitable amount of calcium in cast steel may transform the long-strip like sulfide inclusions in the cast steel into spherical CaS or (Ca, Mn)S inclusions. Oxide and sulfide inclusions formed from calcium have smaller densities, and thus are easier for floatation and removal. Calcium can also inhibit clustering of sulfur along the crystal boundary notably. These are all favorable for increasing the quality of the cast steel, and thus improving the properties of the steel. In the invention, the content of calcium is controlled to be 0.0010-0.0080%, preferably 0.0010-0.0060%.

Vanadium: Vanadium is added mainly for refining grains, so that austenite grains will not grow unduly in the stage of heating the billet. As such, in the subsequent several runs of rolling, the steel grains may be further refined to increase the strength and toughness of the steel. In the invention, vanadium is controlled to be ≤0.080%, preferably ≤0.060%.

Chromium: Chromium may slow the critical cooling rate and enhance the hardenability of the steel. Several carbides, such as $(Fe,Cr)_3C$, $(Fe,Cr)_7C_3$ and $(Fe,Cr)_{23}C_7$, etc., may be formed from chromium in the steel to improve strength and hardness. During tempering, chromium can prevent or slow down the precipitation and aggregation of the carbides, so that the tempering stability of the steel is increased. In the invention, the chromium content is controlled to be ≤0.60%, preferably ≤0.40%.

Phosphorus and sulfur: Sulfur and phosphorus are both harmful elements in wear-resistant steel. Their contents have to be controlled strictly. In the steel of the type according to the invention, the phosphorus content is controlled to be ≤0.015%, preferably ≤0.010%; and sulfur content is ≤0.010%, preferably ≤0.005%.

Nitrogen, oxygen and hydrogen: Excessive oxygen and nitrogen in steel are quite undesirable for the properties of the steel, especially weldability and toughness. However, overly strict control will increase the production cost to a great extent. Therefore, in the steel of the type according to the invention, the nitrogen content is controlled to be ≤0.0080%, preferably ≤0.0050%; the oxygen content is ≤0.0060%, preferably ≤0.0040%; and the hydrogen content is ≤0.0004%, preferably ≤0.0003%.

The method of manufacturing the above stated low-alloy, readily weldable, high-strength, high-toughness, wear-resistant steel plate according to the invention comprises in sequence the steps of smelting, casting, heating, rolling and post-rolling direct cooling, etc. In the heating step, the material is heated to 1000-1200° C. In the rolling step, the initial rolling temperature is 950-1150° C. and the end rolling temperature is 800-950° C. In the post-rolling direct cooling step, water cooling is used and the end temperature of cooling is from room temperature to 300° C.

Preferably, in the heating process, the heating temperature is 1000-1150° C., more preferably 1000-1130° C. In order to increase the production efficiency and prevent excessive growth of the austenite grains and severe oxidation of the billet surface, the heating temperature is most preferably 1000-1110° C.

Preferably, the initial rolling temperature: 950-1100° C.; the end rolling temperature: 800-900° C.; more preferably, the initial rolling temperature: 950-1080° C.; the end rolling temperature: 800-890° C.; and most preferably, the initial rolling temperature: 950-1050° C.; the end rolling temperature: 800-880° C.

Preferably, the end cooling temperature is from room temperature to 280° C., more preferably from room temperature to 250° C., most preferably from room temperature to 200° C.

The contents of carbon and trace alloy are controlled strictly according to the invention by reasonably designing the chemical composition (the contents and ratios of C, Si, Mn, Nb and other elements). The wear-resistant steel plate obtained from such a designed composition has good weldability and is suitable for application in the engineering and mechanical fields where welding is needed. Additionally, the production cost of wear-resistant steel is decreased greatly due to the absence of such elements as Mo, Ni and the like.

The low-alloy, readily weldable, high-strength, high-toughness, wear-resistant steel plate according to the invention has high strength, high hardness and perfect impact toughness, inter alia, is easy for machining such as cutting, bending, etc., and has very good applicability.

The low-alloy, readily weldable, high-strength, high-toughness, wear-resistant steel plate according to the invention has a tensile strength of 1160-1410 MPa, an elongation of 14-16%, a Brinell hardness of 390-470 HBW, a Charpy V-notch longitudinal impact work at −40° C. of 50-110 J, as well as excellent weldability, and elevates the applicability of the wear-resistant steel.

EXAMPLES

Table 1 shows the mass percentages of the chemical elements in the steel plates according to Examples 1-8 of the invention and Comparative Example 1 (CN1865481A).

The raw materials for smelting were subjected to the manufacturing process according to the following steps: smelting→casting→heating→rolling→post-rolling direct cooling. The specific process parameters for Examples 1-8 are shown in Table 2.

It can be known from Table 1 that the carbon content and alloy contents of Example 1 are relatively higher, and its Ceq and Pcm values are far larger than those of the steel type of the invention. Hence, its weldability must be significantly different from the steel type of the invention.

TABLE 1

Compositions of Examples 1-8 according to the invention, wt %

| | C | Si | Mn | P | S | Nb | Al | B | Ti | Ca |
|---|---|---|---|---|---|---|---|---|---|---|
| Ex. 1 | 0.08 | 0.45 | 1.70 | 0.015 | 0.005 | 0.016 | 0.027 | 0.0014 | 0.019 | 0.0010 |
| Ex. 2 | 0.11 | 0.26 | 1.80 | 0.009 | 0.010 | 0.020 | 0.035 | 0.0013 | 0.005 | 0.0040 |
| Ex. 3 | 0.12 | 0.37 | 1.53 | 0.008 | 0.004 | 0.026 | 0.010 | 0.0011 | 0.020 | 0.0080 |
| Ex. 4 | 0.14 | 0.40 | 1.50 | 0.010 | 0.003 | 0.017 | 0.020 | 0.0008 | 0.045 | 0.0060 |
| Ex. 5 | 0.16 | 0.38 | 1.41 | 0.009 | 0.003 | 0.010 | 0.080 | 0.0013 | 0.040 | 0.0050 |

TABLE 1-continued

Compositions of Examples 1-8 according to the invention, wt %

| | | | | | | | | | | |
|---|---|---|---|---|---|---|---|---|---|---|
| Ex. 6 | 0.18 | 0.32 | 1.33 | 0.009 | 0.003 | 0.035 | 0.052 | 0.0012 | 0.035 | 0.0030 |
| Ex. 7 | 0.19 | 0.26 | 1.20 | 0.007 | 0.002 | 0.030 | 0.060 | 0.0006 | 0.050 | 0.0020 |
| Ex. 8 | 0.21 | 0.15 | 1.10 | 0.008 | 0.002 | 0.040 | 0.041 | 0.0010 | 0.027 | 0.0040 |
| Comp. 1 | 0.30 | 0.8 | 2.05 | <0.04 | <0.03 | — | — | — | — | — |

| | V | Cr | N | O | H | Others | Ceq % | Pcm % |
|---|---|---|---|---|---|---|---|---|
| Ex. 1 | 0.060 | 0.60 | 0.0042 | 0.0060 | 0.0004 | — | 0.50 | 0.22 |
| Ex. 2 | 0.080 | 0.40 | 0.0080 | 0.0040 | 0.0002 | — | 0.51 | 0.24 |
| Ex. 3 | 0.020 | 0.22 | 0.0050 | 0.0028 | 0.0002 | — | 0.42 | 0.23 |
| Ex. 4 | / | / | 0.0028 | 0.0021 | 0.0003 | — | 0.39 | 0.23 |
| Ex. 5 | / | 0.28 | 0.0038 | 0.0030 | 0.0003 | — | 0.45 | 0.26 |
| Ex. 6 | 0.041 | 0.19 | 0.0029 | 0.0028 | 0.0002 | — | 0.45 | 0.27 |
| Ex. 7 | 0.029 | / | 0.0035 | 0.0022 | 0.0002 | — | 0.40 | 0.27 |
| Ex. 8 | 0.033 | 0.13 | 0.0032 | 0.0018 | 0.0002 | — | 0.43 | 0.28 |
| Comp. 1 | — | 0.6 | — | — | | Mo: 0.6 | 0.88 | 0.50 |

TABLE 2

Specific process parameters for Examples 1-8 according to the invention

| | Slab heating temperature ° C. | Hold time h | Initial rolling temperature ° C. | End rolling temperature ° C. | Cooling method | End Cooling temperature ° C. | Slab thickness mm |
|---|---|---|---|---|---|---|---|
| Ex. 1 | 1000 | 2 | 950 | 800 | Water cooling | Room temperature | 12 |
| Ex. 2 | 1110 | 2 | 1050 | 838 | Water cooling | 280 | 21 |
| Ex. 3 | 1050 | 2 | 990 | 817 | Water cooling | 158 | 12 |
| Ex. 4 | 1100 | 2 | 1030 | 833 | Water cooling | 300 | 16 |
| Ex. 5 | 1150 | 2 | 1110 | 880 | Water cooling | 250 | 23 |
| Ex. 6 | 1090 | 2 | 970 | 825 | Water cooling | 58 | 15 |
| Ex. 7 | 1130 | 2 | 1080 | 850 | Water cooling | 121 | 31 |
| Ex. 8 | 1200 | 2 | 1150 | 950 | Water cooling | Room temperature | 35 |

Test 1: Test for Mechanical Properties

Sampling was conducted according to the sampling method described in GB/T2974, and the low-alloy, readily weldable, high-strength, high-toughness, wear-resistant steel plates of Examples 1-8 of the invention were subjected to hardness test according to GB/T231.1; impact test according to GB/T229; tensile test according to GB/T228; and bending test according to GB/T232. The results are shown in Table 3.

TABLE 3

Mechanical properties of Examples 1-8 of the invention and Comparative Example 1

| | 90° Cold bending D = 3a | Hardness HBW | Lateral tensile properties: Tensile strength MPa | Lateral tensile properties: Elongation % | Charpy V-notch longitudinal impact work (−40° C.), J |
|---|---|---|---|---|---|
| Ex. 1 | Pass | 390 | 1165 | 16% | 108 |
| Ex. 2 | Pass | 399 | 1175 | 16% | 99 |
| Ex. 3 | Pass | 403 | 1195 | 16% | 92 |
| Ex. 4 | Pass | 411 | 1215 | 16% | 88 |

TABLE 3-continued

Mechanical properties of Examples 1-8 of the invention and Comparative Example 1

| | 90° Cold bending D = 3a | Hardness HBW | Lateral tensile properties: Tensile strength MPa | Lateral tensile properties: Elongation % | Charpy V-notch longitudinal impact work (−40° C.), J |
|---|---|---|---|---|---|
| Ex. 5 | Pass | 423 | 1235 | 15% | 83 |
| Ex. 6 | Pass | 436 | 1300 | 15% | 77 |
| Ex. 7 | Pass | 450 | 1365 | 15% | 61 |
| Ex. 8 | Pass | 462 | 1405 | 14% | 55 |
| Comp. 1 | — | About 370 (HRC40) | 1100 | 12% | — |

As can be seen from Table 3, the steel plates of Examples 1-8 of the invention exhibit 1160-1410 MPa of tensile strength, 14%-16% of elongation, 390-470 HBW of Brinell hardness, and 50-110 J of Charpy V-notch longitudinal impact work at −40° C. This indicates that the steel plates of the invention not only are characterized by high strength, high hardness, high elongation, inter alia, but also have excellent low-temperature impact toughness. Obviously, the steel plates of the invention surpass Comparative Example 1 in terms of strength, hardness and elongation.

Figure 2:
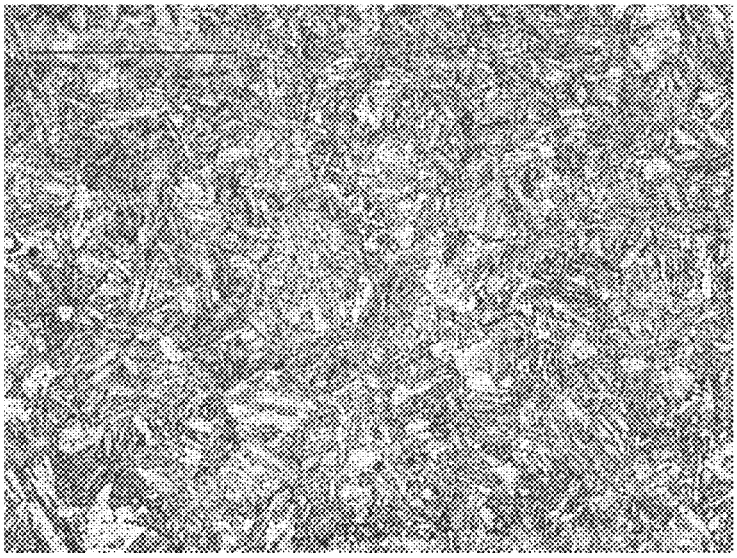
FIG. 2 shows the microstructure of the steel plate according to Example 5, which comprises fine martensite and a small amount of residual austenite, and guarantees that the steel plate has good mechanical properties.

FIG. 2 shows the microstructure of the steel plate according to Example 5, which comprises fine martensite and a small amount of residual austenite and guarantees that the steel plate has good mechanical performances.

Similar microstructures were obtained for the other examples.

Test 2: Test for Weldability

The wear-resistant steel plates of the invention were divided into five groups and subjected to Y-groove weld cracking test according to Testing Method for Y-groove Weld Cracking (GB4675.1-84). The shape and size of a Y-groove weld cracking test coupon is shown in FIG. 1.

Firstly, restraint welds were formed using JM-58 welding wires (Φ1.2) according to Ar-rich gas shielded welding method. During welding, angular distortion of the coupon was controlled strictly. Subsequent to the welding, the practice weld was formed after cooling to room temperature. The practice weld was formed at room temperature. After 48 hours since the practice weld was finished, the weld was examined for surface cracks, section cracks and root cracks. After dissection, a coloring method was used to examine the surface, section and root of the weld respectively. The welding condition was 170 A×25V×160 mm/min.

The low-alloy, readily weldable, high-strength, high-toughness, wear-resistant steel plates of Examples 1-8 of the invention were tested for weldability. The testing results are shown in Table 4.

TABLE 4

Testing results of weldability of Examples 1-8 of the invention

| | Preheating temperature (° C.) | Coupon No. | Surface cracking rate % | Root cracking rate % | Section cracking rate % | Environment temperature | Relative humidity |
|---|---|---|---|---|---|---|---|
| Ex. 1 | No preheating | 1 | 0 | 0 | 0 | 8° C. | 63% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 2 | No preheating | 1 | 0 | 0 | 0 | 16° C. | 60% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 3 | No preheating | 1 | 0 | 0 | 0 | 19° C. | 61% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 4 | No preheating | 1 | 0 | 0 | 0 | 23° C. | 63% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 5 | No preheating | 1 | 0 | 0 | 0 | 26° C. | 66% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 6 | No preheating | 1 | 0 | 0 | 0 | 32° C. | 63% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 7 | 80° C. | 1 | 0 | 0 | 0 | 27° C. | 62% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |
| Ex. 8 | 80° C. | 1 | 0 | 0 | 0 | 33° C. | 61% |
| | | 2 | 0 | 0 | 0 | | |
| | | 3 | 0 | 0 | 0 | | |
| | | 4 | 0 | 0 | 0 | | |
| | | 5 | 0 | 0 | 0 | | |

As can be known from Table 4, no cracks appeared after the wear-resistant steel plates of Examples 1-8 of the invention were welded at environment temperatures of 8-33° C. without preheating (or with preheating at 80° C.), indicating excellent weldability of the wear-resistant steel plates of the invention which are especially suitable for large-size welding parts.

Test 3: Test for Wear Resistance

The wear resistance test was performed on an ML-100 abrasive-wear tester. When a sample was cut out, the axis of the sample was perpendicular to the surface of the steel plate, so that the wearing surface of the sample was just the rolling surface of the steel plate. The sample was machined as required into a stepwise cylinder, wherein the size of the testing part was Φ4 mm, and the size of the holding part for a fixture was Φ5 mm. Before carrying out the test, the sample was washed with alcohol, dried using a blower, and weighed on a balance having a precision of 1/10000 for the sample weight which was used as the original weight. Then, the sample was amounted on a flexible fixture. The test was conducted using an 80 mesh sand paper at a 42 N load. After testing, due to the abrasion between the sample and the sand paper, the sample scribed a spiral line on the sand paper. The length of the spiral line was calculated with the initial and final radii of the spiral line according to the following formula:

$$S = \frac{\pi(r_1^2 - r_2^2)}{a}$$

wherein r1 is the initial radius of the spiral line, r2 is the final radius of the spiral line, and a is the feed rate of the spiral line. In each experiment, the sample was weighed three times and an average was obtained. Then, the weight loss was calculated, and the weight loss per meter was used to represent the wear rate (mg/M) of the sample.

The low-alloy, readily weldable, high-strength, high-toughness, wear-resistant steel plates of Examples 1-8 of the invention were tested for wear resistance. Table 5 shows the wear testing results of the steel type in the Examples of the invention and the steel in Comparative Example 2 (the hardness of the steel plate of Comparative Example 2 was 360 HBW).

TABLE 5

Wear testing results of Examples 1-8 of the invention and Comparative Example 2

| Steel type | Testing temperature | Wear testing conditions | Wear rate (mg/M) |
|---|---|---|---|
| Ex. 1 | Room temperature | 80 mesh sand paper/ 42N load | 9.253 |
| Ex. 2 | Room temperature | 80 mesh sand paper/ 42N load | 9.107 |
| Ex. 3 | Room temperature | 80 mesh sand paper/ 42N load | 8.985 |
| Ex. 4 | Room temperature | 80 mesh sand paper/ 42N load | 8.823 |
| Ex. 5 | Room temperature | 80 mesh sand paper/ 42N load | 8.711 |
| Ex. 6 | Room temperature | 80 mesh sand paper/ 42N load | 8.567 |
| Ex. 7 | Room temperature | 80 mesh sand paper/ 42N load | 8.358 |
| Ex. 8 | Room temperature | 80 mesh sand paper/ 42N load | 8.236 |
| Comp. 2 | Room temperature | 80 mesh sand paper/ 42N load | 10.673 |

As can be known from Table 5, under such wearing conditions, the low-alloy, readily weldable, high-strength, high-toughness, wear-resistant steel plates of the invention have better wear resistance than the steel plate of Comparative Example 2.

The wear-resistant steel according to the invention incorporates small amounts of such elements as Nb, etc. in addition to C, Si, Mn and like elements, into its chemical composition and thus is characterized by simple composition, low cost, etc. A TMCP process is used to produce the wear-resistant steel plate according to the invention without off-line quenching, tempering and other thermal treatment procedures, and thus is characterized by a short production flow, high production efficiency, reduced energy consumption, lower production cost, etc. The wear-resistant steel plate according to the invention has high strength, high hardness and especially very high low-temperature toughness, and the steel plate produced according to the invention has excellent weldability. The wear-resistant steel according to the invention has a microstructure which mainly comprises fine martensite and residual austenite, wherein the volume fraction of the retained austenite is ≤5%; and has a tensile strength of 1160-1410 MPa, an elongation of 14-16%, a Brinell hardness of 390-470 HBW, a Charpy V-notch longitudinal impact work at −40° C. of 50-110 J, facilitating good matching between the strength, hardness and toughness of the wear-resistant steel plate. Thus, the wear-resistant steel plate according to the invention has remarkable advantages.

The invention claimed is:

1. A wear-resistant steel plate, consisting essentially of the following chemical components in weight percentages: C: 0.08-0.21%, Si: 0.15-0.45%, Mn: 1.10-1.80%, P: ≤0.015%, S: ≤0.010%, Nb: 0.010-0.040%, Al: 0.010-0.080%, B: 0.0006-0.0014%, Ti: 0.005-0.050%, Ca: 0.0010-0.0080%, V≤0.080%, Cr≤0.60%, N≤0.0080%, O≤0.0060%, H≤0.0004%, wherein the total amount of Nb and Ti is between 0.025% and 0.080%, the total amount of Al and Ti is between 0.030% and 0.12%, and the balance being Fe and unavoidable impurities.

2. The wear-resistant steel plate of claim 1, wherein C: 0.11-0.19%.

3. The wear-resistant steel plate of claim 1, wherein Si: 0.15-0.40%.

4. The wear-resistant steel plate of claim 1, wherein Mn: 1.20-1.70%.

5. The wear-resistant steel plate of claim 1, wherein P≤0.010% or S≤0.005%.

6. The wear-resistant steel plate of claim 1, wherein Nb: 0.010-0.035%.

7. The wear-resistant steel plate claim 1, wherein Al: 0.020-0.060%.

8. The wear-resistant steel plate of claim 1, wherein B: 0.0008-0.0014%.

9. The wear-resistant steel plate of claim 1, wherein Ti: 0.005-0.045%.

10. The wear-resistant steel plate of claim 1, wherein Ca: 0.0010-0.0060%.

11. The wear-resistant steel plate of claim 1, wherein V≤0.060%, Cr≤0.40%, N≤0.0050%, O≤0.0040%, or H≤0.0003%.

12. The wear-resistant steel plate of claim 1, wherein the total amount of Nb and Ti is between 0.035% and 0.070%, and the total amount of Al and Ti is between 0.040% and 0.11%.

13. The wear-resistant steel plate of claim 1, wherein the tensile strength is 1160-1410 MPa; the elongation is 14%-16%; the Brinell hardness is 390-470HBW; and the Charpy V-notch longitudinal impact work at −40° C. is 50-110J.

14. A method of manufacturing the wear-resistant steel plate of claim 1, comprising in sequence the steps of smelting, casting, heating, rolling and post-rolling direct cooling, wherein in the heating step, the heating temperature is 1000-1200° C. and the hold time is 1-2 hours;

in the rolling step, the initial rolling temperature is 950-1150° C. and the end rolling temperature is 800-950° C.; and in the cooling step, water cooling is used and the end cooling temperature is from room temperature to 300° C.

15. The method of manufacturing the wear-resistant steel plate according to claim 14, wherein:

in the heating step, the hold time is 1-2 hours or 2 hours;

in the heating step, the temperature for heating a slab is 1000-1150° C.;

in the rolling step, the initial rolling temperature is 950-1100° C. and the end rolling temperature is 800-900° C.; or in the cooling step, the end cooling temperature is room temperature to 280° C.

* * * * *